US005323490A

United States Patent [19]

Yarbrough

[11] Patent Number: 5,323,490

[45] Date of Patent: Jun. 28, 1994

[54] GLOVE HAVING STRESS RELIEF AREAS

[76] Inventor: Dan R. Yarbrough, 487 Hampton St., Walterboro, S.C. 29488

[21] Appl. No.: 34,551

[22] Filed: Mar. 19, 1993

[51] Int. Cl.[5] ..... A41D 19/00

[52] U.S. Cl. ..... 2/160.7; 2/163; 2/168

[58] Field of Search ..... 2/168, 163, 167, 159, 2/161 R, 163, 168, 161 A, 16, 161.6, 161.7

[56] References Cited

U.S. PATENT DOCUMENTS

| | | | |
|---|---|---|---|
| 1,241,941 | 10/1917 | Dowd | 2/168 |
| 1,885,572 | 11/1932 | Wood | 2/159 |
| 2,036,413 | 4/1936 | Herbruck | 2/168 |
| 2,335,871 | 12/1943 | Milligan | 2/168 |
| 3,283,338 | 11/1966 | Landau | 2/161 R |
| 4,924,530 | 5/1990 | Tagaya | 2/168 X |

FOREIGN PATENT DOCUMENTS

| | | | |
|---|---|---|---|
| 796667 | 4/1936 | France | 2/163 |
| 1508320 | 1/1968 | France | 2/168 |
| 1569746 | 6/1969 | France | 2/168 |
| 270134 | 5/1927 | United Kingdom | 2/168 |
| 627948 | 8/1949 | United Kingdom | 2/168 |
| 809741 | 3/1959 | United Kingdom | 2/168 |
| 9013232 | 11/1990 | World Int. Prop. O. | 2/168 |

*Primary Examiner*—Clifford D. Crowder
*Assistant Examiner*—Amy B. Vanatta
*Attorney, Agent, or Firm*—B. Craig Killough

[57] ABSTRACT

A glove having stress relief areas located adjacent to individual joints of the hand, fingers and thumb. The stress relief areas provide additional glove material, such as by ribs or bellows formed of peaks and valleys, which reduce the energy expended to overcome the resistance of the material thereby reducing fatigue.

5 Claims, 2 Drawing Sheets

GLOVE HAVING STRESS RELIEF AREAS

BACKGROUND OF THE INVENTION

This invention relates to protective gloves generally, and is more specifically related to a protective glove which can be used while exercising fine motor skills with the hand such as surgical procedures.

Gloves are used as protection for the hand in a variety of applications. Gloves may be made of a variety of materials, including textile materials, latex, rubber, plastic, vinyl, metal, or a combination of these materials.

Gloves, by their very nature, reduce mobility and sensitivity. The motor skills and dexterity of the wearer are reduced by the restrictive nature of the glove. The added barrier between the nerve endings of the hand, fingers, and thumb and the object being touched or held reduces the wearer's dexterity.

Gloves made of thin latex, or vinyl, are used in applications where fine motor skills are needed. A material such as latex has sufficient elasticity to contact the fingers, thumb and hand, as the joints in the hand, fingers and thumb are articulated, giving maximum flexibility. At the same time, the relatively thin latex material allows the wearer to sense, by touch, objects being held or touched for optimum performance of fine motor skills.

However, the elastic property of materials such as latex or vinyl must constantly be overcome by the muscles, resulting in fatigue to the wearer. The muscle groups located in the area of the hand are not particularly large or powerful, and become easily fatigued. While exercising motor skills over a long period, fatigue is increased by the resistance from the elastic nature of the latex or vinyl glove as the glove clings to the fingers, thumb and hand.

Articulation of the metacarpal bone, as it articulates relative to the trapezium where the thumb joins the hand, is a point of stress (and stretching) for a typical latex glove found in the prior art. Likewise, the phalangeal articulation of the joint of the forefinger results in stress as the forefinger is moved. These joints are particularly subject to fatigue since it is the thumb and forefinger which primarily grasp objects during operations requiring fine motor skills, such as surgery.

Surgical gloves as typically found in the prior art, are ambidextrous, that is, there is no differentiation between the palmar and dorsal regions. Accordingly, a glove may be worn on either the right or left hand, with proper fit achieved by the elastic nature of the glove. However, the elastic property which allows the glove to be ambidextrous serves to increase the stress from the elasticity which must be overcome by the user's muscles, thereby increasing fatigue associated with the use of the glove.

SUMMARY OF THE PRESENT INVENTION

The present invention provides an individual stress relief area in a glove adjacent to a joint which allows articulation of the finger or thumb. The stress relief area is characterized by a plurality of ribs or bellows located on the glove adjacent to a joint. The stress relief area allows easier movement of the fingers and thumb within the glove. The stress relief area allows movement of the finger or thumb without requiring the user to stretch the latex, vinyl or other material to overcome the elasticity of the material which fits tightly on the hand. The stress relief area is not present adjacent to the tips of the fingers or thumb, thereby allowing the gloved material to cling tightly to the ends of the fingers and thumb to achieve maximum sensitivity and minimum interference from the glove material, and allowing optimum fine motor skills with the hand while wearing the glove. The ribs or bellows are characterized by a series of peaks and valleys in the glove, resulting in the presence of excess material adjacent to a joint, for maximum flexibility in the joint. A plurality of peaks and valleys result in an accordion effect adjacent to the joint.

DESCRIPTION OF THE PREFERRED EMBODIMENT

Figure 1:
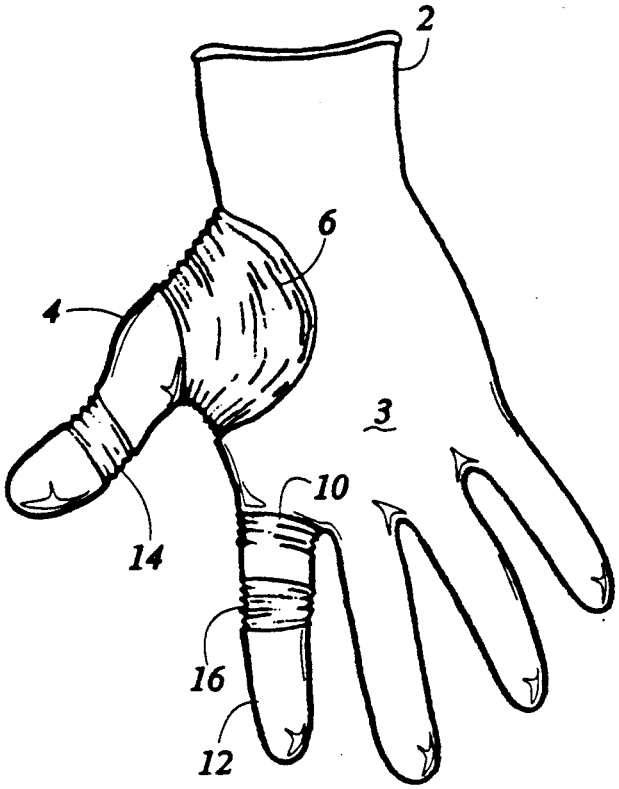
FIG. 1 shows an embodiment of the glove having individual stress relief areas about the circumference of the joint between the thumb and hand, the joint between the forefinger and the hand, and the first joint of the thumb and first joint of the forefinger.
Figure 2:
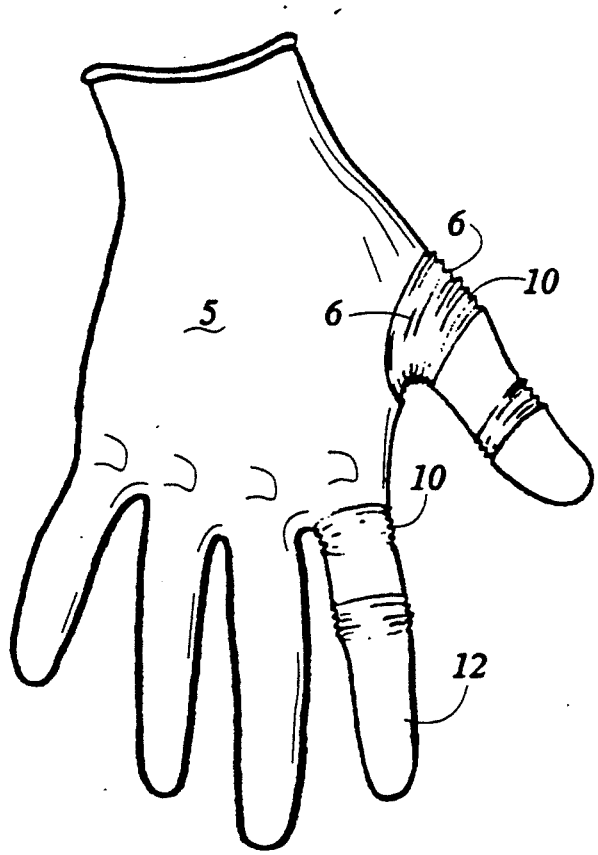
FIG. 2 is the reverse side of the glove shown in FIG. 1.

In the preferred embodiment, the glove 2 is constructed of a thin, flexible material, such as latex or vinyl, which will act as a protective barrier to liquid or fluid materials. The glove material covers the palmar 3 and dorsal 5 regions of a hand and has elongated members extending from the covering which cover the fingers and thumb. The glove can be constructed of any material from which gloves are constructed. The glove may be ambidextrous or formed for the right of left hand. However, the maximum benefit of the present invention is achieved when used with gloves which conform to the shape of the hand as a result of an elastic property of the material, such as latex surgical gloves.

In the preferred embodiment, the material such as latex or vinyl from which the glove is constructed is as thin as possible. However, the glove must provide adequate strength to prevent breakage in normal use, while being reasonably resistant to punctures. The latex or vinyl material is relatively smooth over the palmar and dorsal regions of the hand, and is otherwise relatively smooth over the ends of the finger and thumb, and is smooth except for the stress relief areas. As shown in the drawings, the stress relief areas are only present in association with a joint.

Figure 3:
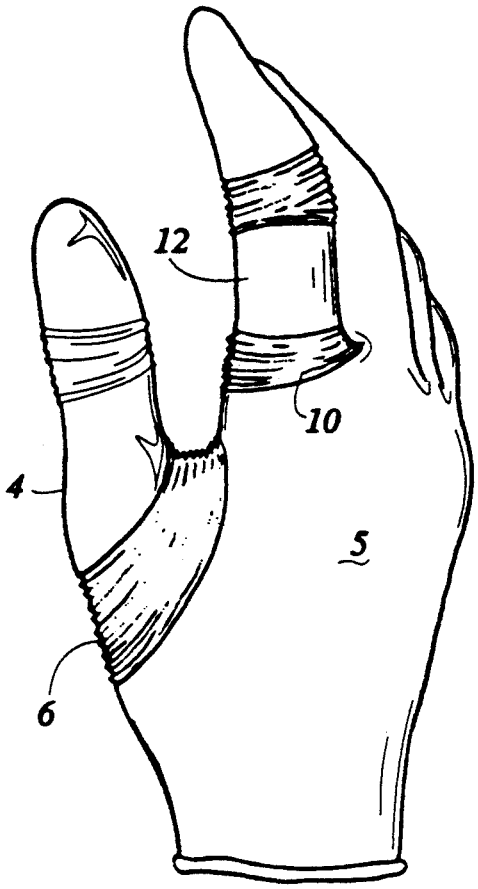
FIG. 3 shows the glove of FIG. 1 with the fingers bent slightly to indicate the movement of the stress relief material.
Figure 4:
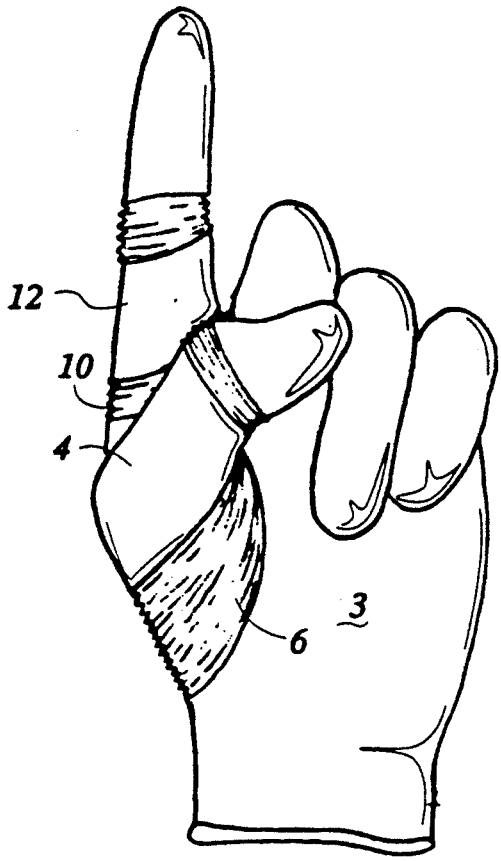
FIG. 4 is the glove shown in FIG. 1 with the forefinger extended, but with the thumb bent to show the movement of the stress relief material as the thumb is articulated relative to the hand.

The joint between the thumb 4 and the hand allows articulation of the metacarpal bone with the trapezium. As the thumb 4 moves from the position shown in FIG. 3 to the position shown in FIG. 4, energy must be expended by the muscles to move the thumb 4 and the glove 2 material. Since the characteristic of the normal latex surgical glove is to cling tightly to the thumb and hand, as the thumb is moved to the position in FIG. 4 from the position in FIG. 3, the latex material of the glove of the prior art is stretched, requiring additional energy from the wearer. Over a period of time, substantial fatigue results. In the preferred embodiment, the invention comprises a series of ribs or bellows 6 which circumscribe the thumb portion of the glove where it joins the hand portion of the glove. The ribs or bellows are comprised of a series of peaks 8 and valleys 10, resulting in an increased surface area of the material at this point. Since additional material is present, it is not necessary to stretch the material by means of the elastic property of the glove material. Accordingly, no energy is expended by the muscles in stretching the material, thereby reducing fatigue to the wearer.

The ribs or bellows 10 may also be present at the joint between the forefinger 12 and the hand to allow metacarpo-phalangeal articulation. The stress relief material may also be present in the joint of the thumb 14 and in the first joint of the forefinger 16, as shown in FIGS. 1 through 4, to allow phalangeal articulation.

Since the thumb and the forefinger which are primarily exercised in surgery, dentistry and other endeavors requiring fine motor skills, the first preferred embodiment shown in FIGS. 1 through 4 uses the stress relief material only in the joints which are relevant to the thumb and forefinger. Application of stress relief material in these areas allow articulation of the thumb and forefinger, while keeping manufacturing costs at a minimum. However, the stress relief material could be provided in additional joints.

Figure 5:
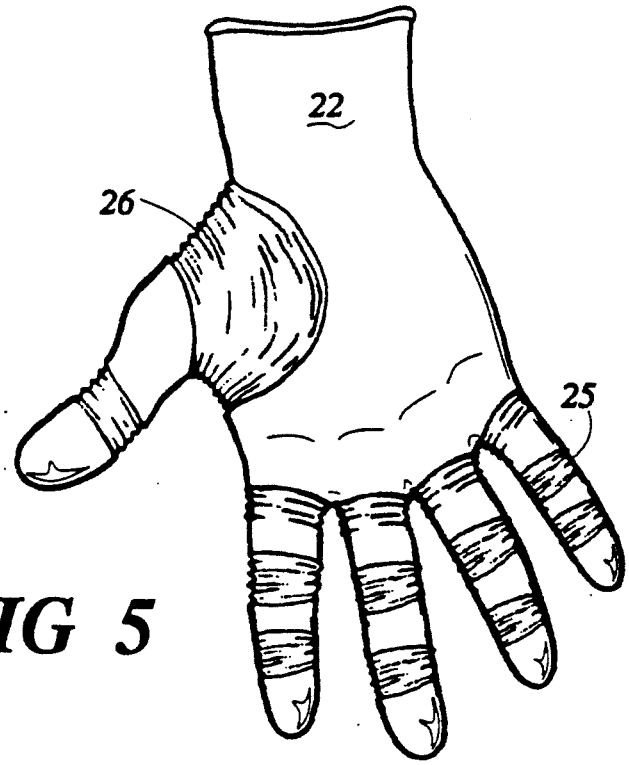
FIG. 5 is an embodiment of the glove showing stress relief materials at each of the joints of the thumb and fingers relative to the hand, and in each of the joints of the fingers and thumb.

FIG. 5 shows a second embodiment of glove 22 wherein the stress relief material is applied to all joints of the finger and the thumb relative to the hand, and at all joints of the fingers, to facilitate articulation. The stress relief material is again a series of ribs or bellows comprised of peaks and valleys which present additional material to reduce the necessity of stretching the material to achieve articulation of the fingers and thumb.

What is claimed:

1. A protective glove having stress relief areas, comprising:

a. a covering for a hand comprised of an elastic material which contacts said hand at substantially all surfaces of said hand, wherein said covering has a smooth surface;

b. a plurality of elongated covering members extending from said covering for said hand and comprised of said elastic material, wherein said elongated covering members contact fingers of a wearer at substantially all surfaces of said fingers and wherein said elongated covering members have a smooth surface;

c. a covering for a thumb of said wearer of the glove comprised of said elastic material, wherein said covering for said thumb is joined to said covering for said hand by a plurality of alternate peaks and valleys formed of said elastic material and which circumscribe an entire circumference of a portion of said covering for said thumb which is located adjacent to a joint between said thumb and said hand which allows articulation of the metacarpal bone with the trapezium, and wherein the remainder of said covering for said thumb has a smooth surface which contacts the remainder of said thumb at substantially all surfaces of said thumb.

2. A protective glove having stress relief areas as described in claim 1, further comprising a plurality of alternate peaks and valleys which circumscribe an entire circumference of a portion of said covering for said thumb which is located adjacent to a joint of said thumb which joins a distal phalanx of said thumb with a proximal phalanx of said thumb, and wherein the remainder of said covering for said thumb has a smooth surface which contacts the remainder of said thumb at substantially all surfaces of said thumb.

3. A protective glove having stress relief areas as described in claim 1, further comprising a covering for a forefinger of a wearer comprised of said elastic material, wherein said covering for said forefinger is joined to said covering for said hand by a plurality of alternate peaks and valleys formed of said elastic material and which circumscribe an entire circumference of a portion of said covering for said forefinger which is located adjacent to a joint of said forefinger which allows metacarpo-phalangeal articulation of said forefinger relative to said hand, and a remainder of said covering has a smooth surface which contacts a remainder of said forefinger at substantially all remaining surfaces of said forefinger.

4. A protective glove having stress relief areas as described in claim 2, further comprising a covering for a forefinger of a wearer comprised of said elastic material, wherein said covering for said forefinger is joined to said covering for said hand by a plurality of alternate peaks and valleys formed of said elastic material and which circumscribe an entire circumference of a portion of said covering for said forefinger which is located adjacent to a joint of said forefinger which allows metacarpo-phalangeal articulation of said forefinger relative to said hand, and a remainder of said covering has a smooth surface which contacts a remainder of said forefinger at substantially all remaining surfaces of said forefinger.

5. A protective glove having stress relief areas as described in claim 4, wherein said covering for said forefinger further comprises a plurality of alternate peaks and valleys formed of an elastic material and which circumscribe an entire circumference of a portion of said covering for said forefinger which is located adjacent to a joint of said forefinger which joins a middle phalange to a proximal phalange of said forefinger.

* * * * *